US006758177B1

(12) United States Patent
McKay et al.

(10) Patent No.: US 6,758,177 B1
(45) Date of Patent: Jul. 6, 2004

(54) METHOD AND APPARATUS TO CONTROL A VARIABLE VALVE SYSTEM

(75) Inventors: Daniel Lee McKay, Brighton, MI (US); Jeffrey M. Pfeiffer, Walled Lake, MI (US); Amanpal S. Grewal, Novi, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/373,000

(22) Filed: Feb. 24, 2003

(51) Int. Cl.[7] ..... F01L 1/34

(52) U.S. Cl. ..... 123/90.15; 123/90.17; 123/90.16

(58) Field of Search ..... 123/90.11–90.18, 123/90.27, 90.31

(56) References Cited

U.S. PATENT DOCUMENTS

| | | | | |
|---|---|---|---|---|
| 5,289,805 A | * | 3/1994 | Quinn et al. | 123/90.17 |
| 5,469,818 A | | 11/1995 | Yoshioka et al. | 123/90.15 |
| 5,570,621 A | | 11/1996 | Kabasin | 91/363 R |
| 5,937,806 A | * | 8/1999 | Lyko et al. | 123/90.15 |
| 6,233,922 B1 | | 5/2001 | Maloney | 60/276 |
| 6,293,267 B1 | | 9/2001 | Smith et al. | 123/568.22 |
| 6,360,531 B1 | * | 3/2002 | Wiemero et al. | 60/284 |
| 6,367,462 B1 | | 4/2002 | McKay et al. | 123/568.21 |
| 6,401,853 B1 | | 6/2002 | Turski et al. | 180/197 |
| 6,422,189 B1 | | 7/2002 | Pierik | 123/90.24 |
| 6,439,176 B1 | | 8/2002 | Payne et al. | 123/90.12 |
| 6,484,676 B2 | * | 11/2002 | Shimizu et al. | 123/90.15 |
| 6,499,451 B1 | | 12/2002 | Hendriksma et al. | 123/90.16 |
| 6,535,809 B1 | | 3/2003 | Beyer et al. | 701/84 |
| 6,588,394 B2 | | 7/2003 | Zheng | 123/198 F |
| 6,588,409 B2 | | 7/2003 | Maloney et al. | 123/686 |
| 6,615,129 B2 | | 9/2003 | Kabasin | 701/110 |
| 6,622,691 B2 | | 9/2003 | Bagnasco et al. | 123/295 |

OTHER PUBLICATIONS

Ashida, U.S. patent application Publication 2002/0174841, Nov. 28, 2002, "Engine Valve Timing Controller".*

* cited by examiner

*Primary Examiner*—Thomas Denion
*Assistant Examiner*—Kyle Riddle
(74) *Attorney, Agent, or Firm*—Jimmy L. Funke

(57) ABSTRACT

The present invention provides an improvement over conventional engine controls by providing a method and system that operates a variable valve system immediately subsequent to engine start, and disengages the variable valve system when engine performance is unacceptable. If the variable valve system is disengaged after engine start due to poor engine performance, a time delay occurs to allow the engine to create a sufficient amount of oil pressure to operate the variable valve system.

13 Claims, 3 Drawing Sheets

METHOD AND APPARATUS TO CONTROL A VARIABLE VALVE SYSTEM

TECHNICAL FIELD

This invention pertains generally to internal combustion engine control systems, and more specifically to control of a variable valve system.

BACKGROUND OF THE INVENTION

Engine manufacturers incorporate variable valve systems, including variable cam phasing systems, to improve operating and emissions performance of internal combustion engines. Distinct engine operating characteristics resulting from use of the variable valve system include improved combustion stability at idle, improved airflow into the engine over a range of engine operations corresponding to improvements in engine performance, and improved dilution tolerance in a combustion charge. Benefits of incorporating the variable valve system into an engine include improved fuel economy, improved torque at low engine speeds, lower engine cost and improved quality through elimination of external exhaust gas recirculation (EGR) systems, and improved control of engine exhaust emissions.

A typical internal combustion engine is comprised of at least one cylinder containing a piston that is attached to a rotating crankshaft by a piston rod. The piston slides up and down the cylinder in response to combustion events that occur in a combustion chamber formed in the cylinder between the piston and a head. The head contains one or more intake valves to control the flow of air and fuel into the combustion chamber, and one or more exhaust valves that control the flow of exhaust gases out of the combustion chamber. A rotating camshaft opens and closes the intake and exhaust valves, and is synchronized with the position of each piston and the crankshaft. As an example of a variable valve system, a typical variable cam phasing system a variable cam phaser attached to an engine camshaft, and a cam position sensor that measures rotational position of the camshaft. The variable cam phasing system varies the opening and closing of each valve by varying angular position and rotation of the camshaft, relative to angular position and rotation of the crankshaft and each respective cylinder. An oil control valve diverts flow of pressurized engine oil to control the variable cam phaser, primarily based upon feedback from the cam position sensor. Typically an electronic engine controller controls this operation.

Engine oil contained in the variable valve system drains into an engine crankcase subsequent to engine shutdown. The rate of drainage from the variable valve system and time necessary to completely drain the system is not readily determinable. Therefore, the amount of oil left in the variable valve system at engine restart is unknown. When the engine is restarted, the control system for the variable valve system may immediately attempt to control position of the valve system, to achieve driveability and emissions benefits resulting from operation of the variable valve system. When there is insufficient oil to operate the system, the result is unstable engine operation. This includes the variable valve device impacting against an engaged locking pin, causing audible noise and wear of the variable valve device. If the locking pin is disengaged, the variable valve device may be uncontrolled, thus affecting engine performance when the variable valve device is not able to attain the desired control position. Engine performance is adversely affected until a sufficient quantity of oil is pumped into the variable valve system to enable effective control of the variable valve system.

Engine performance is affected because control of the valve opening affects mass of air flowing into an individual cylinder, thus affecting volumetric efficiency of the internal combustion engine. This in turn affects quantity of fuel delivery, because fuel delivery is typically determined by measuring or calculating mass air flow and determining an air/fuel ratio that is required to meet operator performance requirements and engine emissions requirements. The quantity of fuel delivered to each cylinder is determined based upon the mass airflow and the required air/fuel ratio. A combustion charge is created in each combustion chamber by delivering the quantity of fuel near the intake valve of the cylinder, or directly into the cylinder. This is known to one skilled in the art. When the mass air flow into the cylinder is unpredictable, due to an unknown position of the variable cam phaser, the controller may overfuel or underfuel the combustion charge. This results in problems with combustion stability and variations in air/fuel ratio that affect emissions, engine noise, and driveability.

Pressure and flow of engine oil into the variable valve system is affected by several factors in the system at engine start and initial operation. These factors include engine oil pump capacity; oil temperature, viscosity, age and level of contamination; variable valve system part-to-part variability, caused by manufacturing tolerances and component wear; and engine temperature at startup. These factors result in an inability of the controller to precisely determine position of the variable valve device. The previously described benefits derived from use of a variable valve system may be compromised due to the variations. An engine with dual cylinder banks may experience differences between the two banks that are caused by differences in oil pressure and flow at each bank. The result is further reduced engine performance during engine start and initial operation due to vibration and engine instability caused by variations in bank-to-bank airflow, individual cylinder fueling, and volumetric efficiencies.

The prior art has sought to eliminate the problem of oil drainage from the engine and the variable valve system by delaying operation of the variable valve system for a predetermined amount of time subsequent to an engine start event, to allow buildup of engine oil pressure. This delayed operation may result in driveability complaints and increases in engine emissions if operation is delayed for a significant amount of time. What is needed is a system that operates the variable valve system immediately after engine start, and disengages the variable valve system when engine performance is unacceptable.

SUMMARY OF THE INVENTION

The present invention provides an improvement over conventional engine controls by providing a method and system that operates a variable valve system immediately after engine start, and disengages the variable valve system when engine performance is unacceptable. If the variable valve system is disengaged after engine start due to poor engine performance, a time delay occurs to allow the engine to create a sufficient amount of oil pressure to operate the variable valve system.

The invention includes a method to control a variable valve device for an internal combustion engine. This includes operating the variable valve device immediately subsequent to an engine start event, and monitoring a first control error and discontinuing the operation of the variable valve device if the first control error is greater than a first calibratable value. The first control error comprises calculating a standard error based upon a difference between a measured position of the variable valve device and a commanded position of the variable valve device. This is calculated over a predetermined amount of time subsequent to the engine start event. The method further comprises monitoring a second control error and discontinuing the operation of the variable valve device if the second control error is greater than a second calibratable value. The second control error comprises the integral term of a predetermined proportional-integral-derivative control strategy. The variable valve device comprises a variable cam phaser, or a variable lift and duration device, or a variable valve timing device.

The invention also includes a system to control the variable valve device for an internal combustion engine, including a controller comprised of internal algorithms and calibrations, and operable to control the variable valve device. The controller is electrically connected to at least one sensor that monitors engine operating conditions. The controller executes the internal algorithms and calibrations to operate the variable valve device immediately after an engine start event, and monitor engine operating conditions. The controller determines a first control error and a second control error, based upon the monitored engine operating conditions, and enables the variable valve device to operate only if the first control error is less than a first calibratable value and the second control error is less than a second calibratable value.

These and other aspects of the invention will become apparent to those skilled in the art upon reading and understanding the following detailed description of the embodiments.

BRIEF DESCRIPTION OF THE DRAWINGS

The invention may take physical form in certain parts and arrangement of parts, the preferred embodiment of which will be described in detail and illustrated in the accompanying drawings which form a part hereof, and wherein.

DETAILED DESCRIPTION OF THE PREFERRED EMBODIMENT

Figure 1:
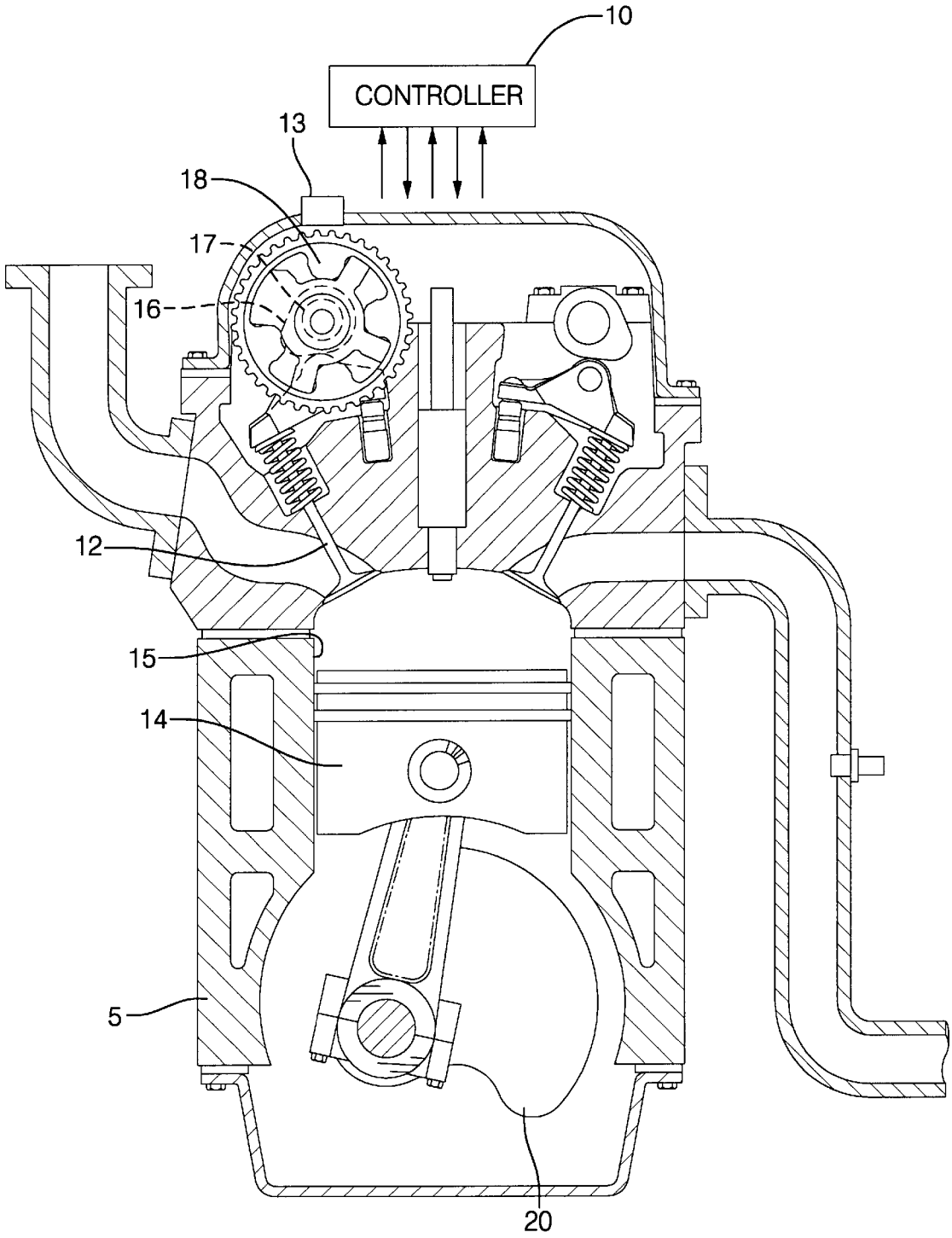
FIG. 1 is a schematic diagram of an engine with a variable cam phasing system, in accordance with the present invention.

Referring now to the drawings, wherein the showings are for the purpose of illustrating an embodiment of the invention only and not for the purpose of limiting the same, FIG. 1 shows an internal combustion engine 5, controller 10 and variable valve system which has been constructed in accordance with an embodiment of the present invention. The engine 5 has an intake camshaft 16 that rotates around an axis and is operable to open and close each intake valve 12 corresponding to each cylinder 15 of the engine 5. The intake camshaft 16 opens each intake valve 12 relative to a top-dead center point of a piston 14 in the corresponding cylinder 15. The opening of each intake valve 12 is measured in units of degrees of camshaft rotation before the top-dead center point, and is also correlated to a position of a crankshaft 20 that is operably attached to each piston. The engine 5 with pistons, camshafts, crankshaft 20 and the controller 10 are well known to one skilled in the art.

The controller 10 is preferably operably attached to sensors and output devices to monitor and control engine operation. The output devices preferably include subsystems necessary for proper control and operation of the engine, including a fuel injection system, a spark-ignition system, an electronic throttle control system, an exhaust gas recirculation system, and an evaporative control system (not shown). The sensors include devices operable to monitor engine operation, external conditions, and operator demand, and are electrically attached to the controller 10. The engine sensors preferably comprise the cam position sensor 13, an exhaust gas sensor, a crank speed sensor that measures engine speed, a manifold absolute pressure sensor for determining engine load, a throttle position sensor, a mass air flow sensor, a coolant temperature sensor, and others (not shown). Other sensors preferably include an accelerator pedal position sensor, among others (not shown). The controller 10 controls operation of the engine 5 by collecting input from the sensors and controlling the output devices, using control algorithms and calibrations internal to the controller 10 and the various sensors. The use of the controller to control operation of the internal combustion engine using output devices, based upon input from various sensors, is well known to those skilled in the art.

Referring again to FIG. 1, an embodiment of the invention is shown and comprises an engine with a single bank of in-line cylinders and an intake camshaft 16 operable to open and close each of the intake valves. The variable valve system is preferably a variable cam phasing system that controls the rotation of the intake camshaft 16, and hence the opening and corresponding closing of each intake valve 12 relative to the top-dead center point of each piston 14 in each corresponding cylinder 15. The variable valve device of the variable cam phasing system is preferably comprised of a single vane-type variable cam phaser 18 operably attached to the intake camshaft 16, and fluidly connected to an oil control valve 17. The controller 10 is electrically operably connected to the oil control valve 17. The oil control valve is preferably a pulsewidth-modulated ('PWM') control valve, wherein the controller 10 sends a PWM electrical signal to the oil control valve to control valve opening and flow of pressurized engine oil to the vane-type variable cam phaser 18. A cam position sensor 13 is operable to measure angular rotation of the camshaft and is signally electrically connected to the controller 10. The controller 10 uses internal control algorithms and calibrations to determine the appropriate PWM electrical signal to send to the oil control valve to control flow of pressurized engine oil to the variable cam phaser 18, based upon the angular rotation of the camshaft 16 and a desired angular rotation of the camshaft. The engine 5 with the variable cam phasing system and the controller 10 are well known to those skilled in the art.

Figure 2:
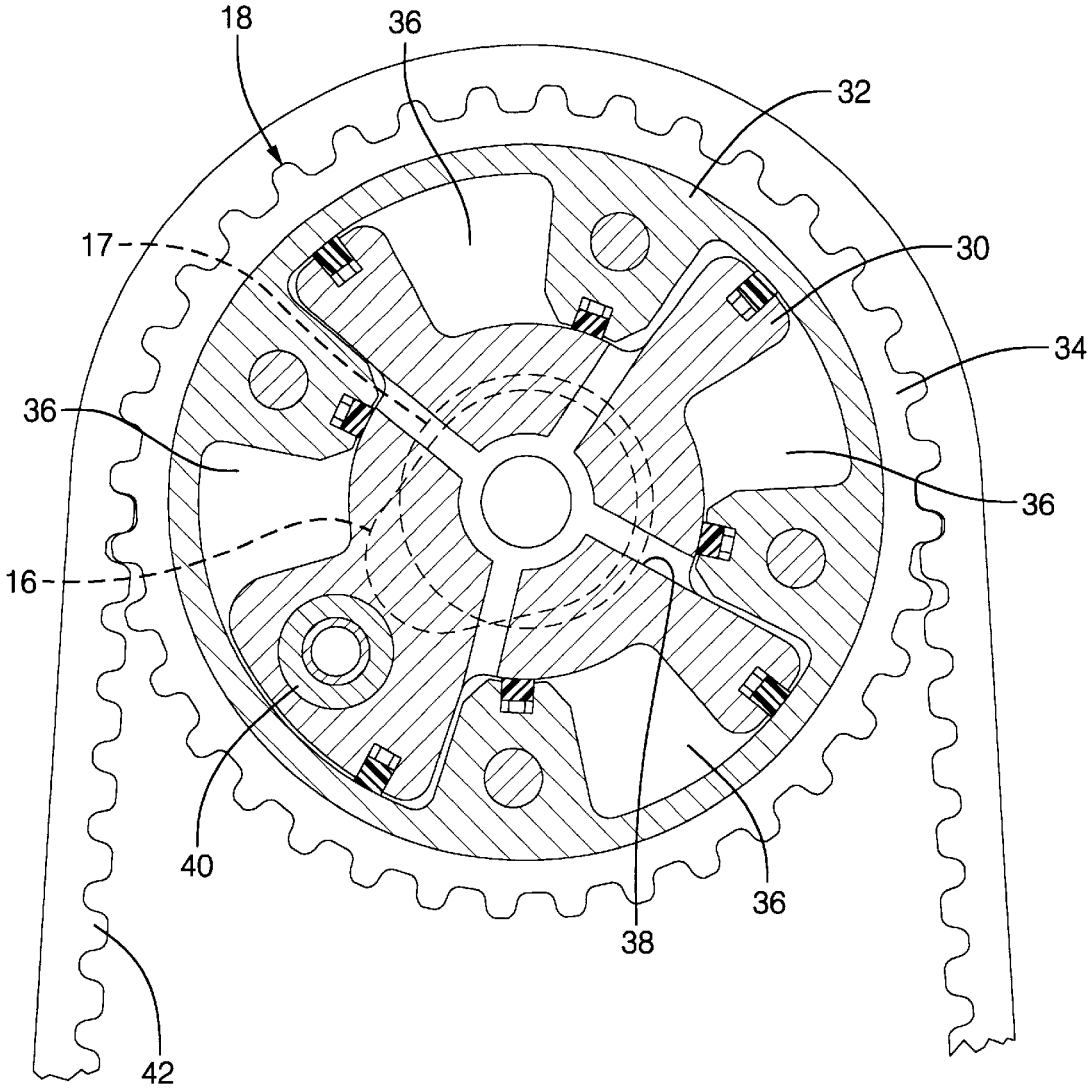
FIG. 2 is a schematic diagram of a variable cam phasing system, in accordance with the present invention; and, FIG. 3 is a flowchart, in accordance with the present invention.

Referring now to FIG. 2, the variable cam phaser 18 is shown. The variable cam phaser 18 is a rotating device that comprises a rotor 30, a stator 32, a pulley and base 34, and a cover (not shown). The rotor 30 is operably attached coaxial to the camshaft 16, and is coaxial to and contained within the stator 32. The stator 32 is operably attached to the pulley and base 34 and is comprised of a plurality of hydraulic chambers 36. The rotor 30 is preferably comprised of a plurality of rigid vanes, each vane corresponding to the plurality of hydraulic chambers 36 of the stator 32. The rotor 30 contains oil passages 38 for flow of pressurized engine oil from the oil control valve 17 through to each of the plurality of hydraulic chambers 36 contained in the stator 32. The rotor 30 also includes a locking pin 40 that operably fixes rotational position of the rotor 30 relative to the stator 32 when the locking pin is engaged. The pulley and base 34 are preferably driven by a belt 42 that in turn is driven by a second pulley (not shown) operably attached to the crankshaft 20. Variable cam phasers are known to one skilled in the art.

In operation, rotation of the crankshaft 20 and second pulley (not shown) causes movement of the belt 42 (not shown), which in turn causes rotation of the pulley and base 34, and thus rotating the stator 32 and camshaft 16 on their axis. When the locking pin 40 is engaged, the stator 32 and rotor 30 rotate as a fixed device, thus rotating the camshaft 16 to open each of the intake valves 12 in a fixed manner relative to top-dead center position of each corresponding piston. When the locking pin 40 is disengaged, the rotor 30 rotates inside the stator 32 according to the amount of pressurized oil that flows from the engine through the oil control valve (not shown) through the oil passages 38 to each hydraulic chamber. The pressurized oil applies hydraulic force to each of the vanes of the rotor 30 to rotate the rotor within the stator 32. When the rotor 30 rotates within the stator 32, it changes angular position of the camshaft relative to the crankshaft, and hence changing the opening and closing of each intake valve relative to top-dead center point of the piston. Operation of a variable cam phasing system is known to one skilled in the art.

The internal control algorithms and calibrations used by the controller 10 to determine the appropriate PWM electrical signal to send to the oil control valve preferably comprise a proportional-integral-differential ('PID') control scheme. PID control schemes are known to one skilled in the art. The PID control scheme includes an integral term that comprises the PWM electrical signal, in terms of duty cycle, sent from the controller 10 to the oil control valve 17.

Figure 3:
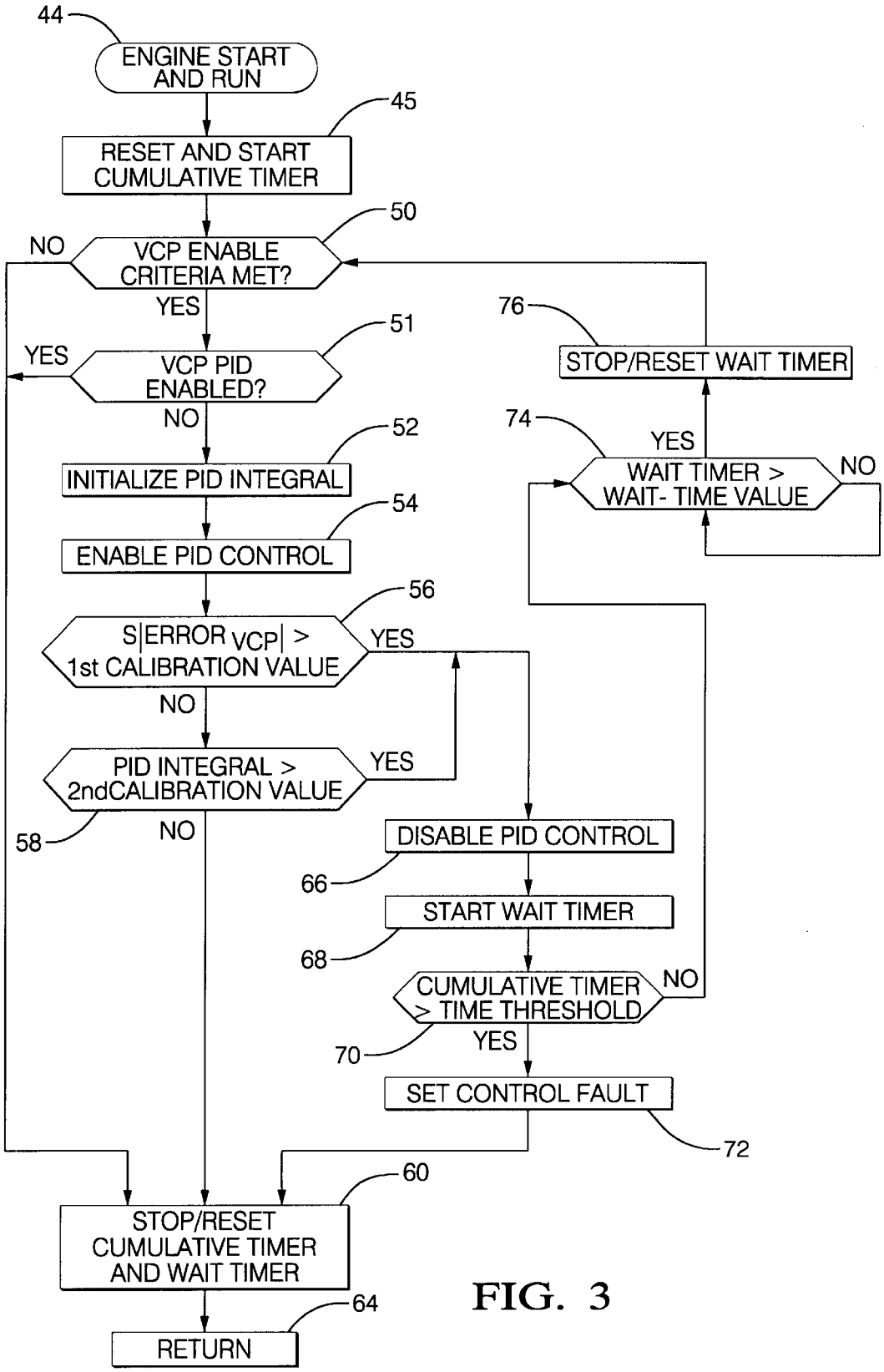

Referring now to FIG. 3, a flowchart of the invention is shown. The flowchart comprises a method to control the variable valve device for the internal combustion engine 5 during engine start and initial operation, preferably using the PID control scheme that is executed as algorithms and calibrations contained within the controller 10. The method is described in context of the variable cam phasing system of FIGS. 1 and 2. The method includes resetting and starting a cumulative timer (step 45) subsequent to engine start and run (step 44). If all the enable criteria for the variable cam phasing system are not met (step 50), the method discontinues operation (step 64), and normal engine operation, without cam phasing, commences immediately thereafter.

If the enable criteria are not met (step 50), the method determines whether the PID control system has been enabled (step 51). If the PID control system has been enabled, the method returns and discontinues operation of the algorithm (step 64). Normal engine operation, without cam phasing, commences immediately thereafter. If the PID control system has not been enabled, the method initializes the PID integral value (step 52), and enables operation of the PID control scheme (Step 54). The method monitors a first control error, a second control error, and elapsed time subsequent to engine start, using the cumulative timer. The PID control scheme continues to operate only if the first control error, represented as $S|ERROR_{vcp}\uparrow$ is less than a first calibratable value (step 56) and the second control error is less than a second calibratable value (step 58). During operation of the engine subsequent to start, if the first control error exceeds the first calibratable value (step 56) or the second control error exceeds the second calibratable value (step 58), the method disables the PID control scheme (step 66). A wait timer is started (step 68). If the cumulative time has not exceeded a calibrated time threshold (step 70), the method waits for the wait timer to exceed a wait-time value (step 74). The method stops and resets the wait timer (step 76) and reevaluates whether the variable valve enable criteria are met (step 50). If, after the cumulative time exceeds the calibrated time threshold (step 70), the first control error exceeds the first calibratable value, or the second control error exceeds the second calibratable value, the method sets a control fault (step 72), and returns and discontinues operation of the algorithm (step 64). The controller 10 preferably executes the algorithm embodying the method described in FIG. 2 during each 15.6-millisecond loop cycle. When the algorithm returns and discontinues operation (step 64), the controller restarts the algorithm at step 50 during the subsequent 15.6-millisecond loop cycle. Thus, if the variable valve enable criteria are subsequently met, the variable cam phasing system is enabled at that time.

The enable criteria (step 50) for operating the variable cam phasing system preferably comprise a determination of engine speed, using the crank speed sensor (not shown), and engine operating temperature, using the coolant temperature sensor (not shown), among other criteria. Typical values for enable criteria include engine speed exceeding 1000 revolutions per minute, and coolant temperature within a range of 0° C. to 100° C.

The initial value of the PID integral, the first calibrated value, the second calibrated value, the wait-time value, and the calibrated time threshold are each predetermined during engine development phase prior to mass-production of the engine design. The aforementioned values are preferably stored in appropriate locations in the controller 10 and used by algorithms that have been created to execute the method described herein. One skilled in the art is able to determine appropriate calibration values using representative engines, and calibrate the controller 10 to execute algorithms that use the aforementioned calibration values.

The initial value of the PID integral (used in step 52) which also comprises the PWM electrical signal from the controller 10 to the oil control valve 17, is preferably set at a duty cycle of 50–60%. This value is preferably determined based upon an integral term required for steady state phasing operation at a given set of oil conditions (either pressure or temperature), and is determined during engine calibration, prior to mass production.

The first control error preferably comprises a standard error measure of a desired cam position as compared to a measured cam position. Measured cam position is preferably determined at opening of each of the intake valves 12 relative to top-dead center position of each corresponding piston. The standard error preferably comprises a sum of absolute value of differences between desired cam position and measured cam position. The desired cam position and the measured cam position are determined each control loop cycle, in this case preferably during each 15.6-millisecond loop, and the standard error is calculated accordingly. The first calibrated value is calculated accordingly, and is based upon engine operating conditions. Control loop cycles are known to one skilled in the art. One skilled in the art is able to create algorithms for a controller that calculate standard error, based upon desired and measured cam positions.

The first calibratable value (step 56) comprises a maximum threshold value for the standard error, as a function of elapsed time. It is preferably determined by testing development engines prior to start of mass-production. The maximum threshold value is defined to be a level of error between the desired cam position and the measured position sufficient to cause unacceptable emissions levels or other engine performance problems. One skilled in the art is capable of determining error levels sufficient to lead to unacceptable emissions or other engine performance problems.

The second control error preferably includes monitoring the integral term that comprises the PWM electrical signal, in terms of duty cycle, from the controller 10 to the oil control valve 17. The second control error is determined using control theory analysis methods, including the integral term and any phasing error. The second control error along with proportional and derivative terms from the PID controller drive the PWM electrical signal. The second calibratable value (step 58) preferably comprises the PWM duty cycle at or near 100%, indicating that the PID control scheme has saturated and is unable to effectively control the variable valve device.

The wait-time value (used in steps 68, 74) is preferably an amount of time necessary for the engine 5 and oil pump (not shown) to fill the oil passages 38 after the engine oil has completely drained out of the engine 5, after operation. The wait-time value is preferably determined using a representative engine during engine development. The representative engine is allowed to stand until all oil has drained into the engine crankcase. The engine is started and oil pressure at the oil control valve (not shown) is monitored, along with elapsed time subsequent to engine start event. The wait-time value is determined to be an amount of elapsed time subsequent to the engine start event until the oil pressure reaches an acceptable pressure level, typically 1.5 bar.

The calibratable time threshold (used in step 70) is preferably a maximum amount of time allowable before inoperation of the variable valve timing device affects emissions performance, and is based upon applicable emissions and diagnostic regulations. The calibratable time threshold is preferably determined with representative engines during engine development. A representative engine is operated over an emissions test cycle with the variable-valve timing device disabled, while measuring exhaust emissions on a second-by-second basis. The representative engine is again operated over an emissions test cycle with the variable-valve timing device enabled, again while measuring exhaust emissions on a second-by-second basis. The exhaust emissions results for each test are compared, and the calibratable time threshold is determined based upon the compared emissions results, and the applicable emissions and diagnostic regulations. Calibration of a time threshold in this manner is known to one skilled in the art.

Although this is described as a variable cam phasing system, it is understood that alternate embodiments of this invention include variable valve timing systems, variable valve lift and duration systems, and others. It is also understood that the invention includes variable valve systems employed on internal combustion engines, including, for example, spark-ignition and compression-ignition engines. It is further understood that the invention includes all applications of internal combustion engines, including, but not limited to, passenger vehicles, trucks, off-road equipment, stationary engines, watercraft, and boats.

The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. A method to control a variable valve device for an internal combustion engine, comprising:

operating the variable valve device immediately subsequent to an engine start event before determining if enable criteria are met;

monitoring a first control error; and, discontinuing the operation of the variable valve device if the first control error is greater than a first calibratable value.

2. The method of claim 1, wherein monitoring the first control error comprises calculating a standard error based upon a difference between a measured position of the variable valve device and a commanded position of the variable valve device.

3. The method of claim 1, further comprising:

monitoring a second control error; and, discontinuing the operation of the variable valve device if the second control error is greater than a second calibratable value.

4. The method of claim 3, further comprising:

measuring an elapsed time subsequent to the engine start event; and, setting a control fault when the first control error exceeds the first calibratable value for a predetermined amount of time subsequent to the engine start event.

5. The method of claim 4, further comprising:

setting the control fault when the second control error exceeds the second calibratable value for the predetermined amount of time subsequent to the engine start event.

6. The method of claim 5, wherein operating the variable valve device comprises initializing an integral term of a predetermined proportional-integral-derivative control strategy, and controlling the variable valve device using the predetermined proportional-integral-derivative control strategy.

7. The method of claim 6, wherein monitoring the second control error comprises monitoring the integral term of the predetermined proportional-integral-derivative control strategy.

8. The method of claim 4, further comprising waiting an amount of time necessary for the engine to fill oil passages prior to determining whether the variable valve enable criteria are met.

9. A method to control a variable valve device for an internal combustion engine, comprising:

operating the variable valve device immediately subsequent to the engine start event before determining if enable criteria are met;

monitoring a first control error;

monitoring a second control error;

enabling the variable valve device to continue operating only if the first control error is less than a first calibratable value and the second control error is less than a second calibratable value;

setting a control fault when the first control error exceeds the first calibratable value for a predetermined amount of time subsequent to the engine start event; and, setting the control fault when the second control error exceeds the second calibratable value for the predetermined elapsed time subsequent to the engine start event.

10. A system to control a variable valve device for an internal combustion engine, comprising:

a controller including input devices and operable to control external devices, and further comprising internal algorithms and calibrations; said controller operably connected to the variable valve device, and, electrically connected to at least one sensor operable to monitor engine operating conditions;

wherein said controller is operable to execute the internal algorithms and calibrations to:

operate the variable valve device immediately subsequent to an engine start event before determining if enable criteria are met;

monitor engine operating conditions, based upon input from the at least one sensor;

determine a first control error and a second control error, based upon the monitored engine operating conditions; and, enable the variable valve device to operate only if the first control error is less than a first calibratable value and the second control error is less than a second calibratable value.

11. The system of claim 10, wherein the variable valve device comprises a variable cam phaser.

12. The system of claim 11, wherein the variable valve device comprises a variable valve timing device.

13. The system of claim 10, wherein the variable valve device comprises a device for variable control of lift and duration of a valve.

* * * * *